US007882893B2

(12) United States Patent
Fraim

(10) Patent No.: US 7,882,893 B2
(45) Date of Patent: Feb. 8, 2011

(54) COMBINED MISCIBLE DRIVE FOR HEAVY OIL PRODUCTION

(75) Inventor: Michael Fraim, Corrales, NM (US)

(73) Assignee: Legacy Energy, Carpinteria, CA (US)

( * ) Notice: Subject to any disclaimer, the term of this patent is extended or adjusted under 35 U.S.C. 154(b) by 228 days.

(21) Appl. No.: 12/013,071

(22) Filed: Jan. 11, 2008

(65) Prior Publication Data

US 2009/0178806 A1 Jul. 16, 2009

(51) Int. Cl.
*E21B 43/22* (2006.01)
*E21B 43/24* (2006.01)
*E21B 43/243* (2006.01)

(52) U.S. Cl. ..... 166/260; 166/261; 166/270.1; 166/272.1; 166/272.2; 166/272.6; 166/309; 507/202

(58) Field of Classification Search ..... 166/261, 166/263
See application file for complete search history.

(56) References Cited

U.S. PATENT DOCUMENTS 2,875,833 A * 3/1959 Martin ..... 166/268
3,196,945 A 7/1965 Craig et al.
3,208,519 A * 9/1965 Moore ..... 166/261
3,279,538 A 10/1966 Doscher
3,342,261 A * 9/1967 Bond ..... 166/305.1
3,400,760 A 9/1968 Orkiszewski
3,409,077 A 11/1968 Durie
3,542,129 A 11/1970 Bauer
3,563,312 A 2/1971 Zwicky
3,661,820 A 5/1972 Foreman et al.
3,913,672 A * 10/1975 Allen et al. ..... 166/402
3,976,137 A 8/1976 Bousaid
3,978,925 A 9/1976 Redford
3,991,828 A 11/1976 Allen et al.
3,999,606 A 12/1976 Bandyopadhyay et al.
4,004,636 A 1/1977 Brown et al.
4,026,358 A 5/1977 Allen
4,059,152 A 11/1977 Allen et al.
4,099,568 A 7/1978 Allen
4,114,690 A 9/1978 Cram et al.
4,127,172 A 11/1978 Redford et al.
4,271,905 A 6/1981 Redford et al.
4,415,031 A * 11/1983 Hunt, III ..... 166/261
4,474,237 A 10/1984 Shu
4,475,592 A 10/1984 Pachovsky
4,495,994 A 1/1985 Brown et al.
4,560,003 A * 12/1985 McMillen et al. ..... 166/305.1
4,593,759 A 6/1986 Penick
4,649,997 A 3/1987 Bousaid
4,690,215 A 9/1987 Roberts et al.

(Continued)

OTHER PUBLICATIONS

Gates, C.F. et al.., "*In-Situ Combustion in the Tulare Formation*, South Belridge Field, Kern County, California," May 1978, Journal of Petroleum Technology, pp. 798-806.

(Continued)

*Primary Examiner*—George Suchfield
(74) *Attorney, Agent, or Firm*—Baker & Hostetler LLP

(57) ABSTRACT

A method of oil production is provided. The method includes forming an injection well and a production well. The method also includes pumping a mixture of oxygen and carbon dioxide ($CO_2$) into the injection well. In addition, the method also includes minimizing gravity segregation by providing a relatively high level of $CO_2$ in the mixture.

18 Claims, 3 Drawing Sheets

U.S. PATENT DOCUMENTS

| | | | | |
|---|---|---|---|---|
| 4,718,489 | A | 1/1988 | Hallam et al. | |
| 4,722,395 | A | 2/1988 | Venkatesan | |
| 4,729,431 | A * | 3/1988 | Bousaid | 166/261 |
| 4,846,275 | A | 7/1989 | McKay | |
| 4,860,827 | A | 8/1989 | Lee et al. | |
| 4,979,564 | A | 12/1990 | Kalpakci et al. | |
| 5,020,595 | A | 6/1991 | Van Slyke | |
| 5,128,023 | A | 7/1992 | Reid et al. | |
| 5,145,002 | A | 9/1992 | McKay | |
| 5,221,462 | A | 6/1993 | Reid et al. | |
| 5,282,984 | A | 2/1994 | Ashrawi | |
| 5,626,191 | A | 5/1997 | Greaves et al. | |
| 6,412,557 | B1 | 7/2002 | Ayasse et al. | |
| 6,772,771 | B2 | 8/2004 | Cai et al. | |
| 2006/0042794 | A1 | 3/2006 | Pfefferle | |
| 2006/0207762 | A1 | 9/2006 | Ayasse | |
| 2006/0289157 | A1 | 12/2006 | Rao | |
| 2008/0135244 | A1 * | 6/2008 | Miller | 166/272.6 |

OTHER PUBLICATIONS

Hvizdos, Leonard J. et al., "*Enhanced Oil Recovery Through Oxygen-Enriched In-Situ Combustion: Test Results From the Forest Hill Field in Texas*," Jun. 1983, Journal of Petroleum Technology, pp. 1061-1070.

Shu, W.R.et al., "*Potential Benefit of $CO_2$ in Oxygen Combustion*," Jul. 1984, Journal of Petroleum Technology, pp. 1137-1138 and 4 additional pages of tables and figures by same authors.

* cited by examiner

COMBINED MISCIBLE DRIVE FOR HEAVY OIL PRODUCTION

FIELD OF THE INVENTION

The present invention relates generally to devices and methods for oil extraction. More particularly, certain embodiments of the present invention relate to devices and methods for extracting heavy oil.

BACKGROUND OF THE INVENTION

In order to extract maximum amount of oil from the earth, at least one injection well and several production wells are typically drilled into the target oil formation (e.g., an oil reservoir). Typically, water is pumped into the injection well to displace low-viscosity oil from the target formation to the production well. After water-flooding the target formation, the residual oil saturation ranges from 30% to 50%, depending on the oil-water mobility ratio. To reduce the residual oil saturation to below 20%, steam, miscible gas or a surfactant solution is pumped into the injection well to flood the target formation to the production wells.

Because of their inherent high viscosities, tars and heavy oils can not be displaced at economic rates with water, surfactant solutions or miscible gas to the production well. As such, thermal oil recovery techniques are often used to reduce the in-situ oil viscosity to below 100 cp so the oil can be displaced by a fluid or gravity drained at economic rates. Currently available techniques include steam injection, in-situ combustion, and in-situ wet combustion.

Steam Injection

In the process of steam-flooding an oil reservoir, steam is pumped into the target formation through the injection well. More specifically, steam is injected into the target formation through perforations in the vertical well completion or through a slotted liner in a horizontal well completion. Since steam is a hot, light gas instead of a dense liquid, it will tend to gravity-override the oil in the formation around 30 feet from the injection well.

Initially, the steam pushes condensed hot water through the top of the formation and the hot water drags liquefied heavy oil to the production well. After steam breaks through into the production well, the hot, low-viscosity, heavy oil gravity-drains towards the production well or down-dip of the production well to create a bypassed oil zone.

After the steam-to-oil ratio increases above a specified economic level, the perforations of the highest permeability layer are blocked off in the production well to prevent steam from cycling from the injection well to the production well without any recovery of oil. Eventually, after all available perforated layers have been produced, the wells are plugged and a new pattern of wells are drilled in an unswept area.

Steam injection processes typically suffer from heat losses to the upper and lower layers surrounding the target formation. More specifically, at deeper depths, the steam condenses into water at higher temperatures which, in turn, requires the steam be injected at a higher temperature and, in turn, increases the heat loss rate to the surrounding layers, corrosion rate of the steel tubulars and enhanced energy usage of the steam generator. Thus, steam-flooding heavy oil formations usually become economically undesirable at depths greater than approximately 4500 ft.

In-Situ Combustion

In the process of in-situ combustion, a gas containing oxygen (e.g., air) is pumped into the injection well instead of steam. As the gaseous oxidizer is pumped into the target formation, a fraction of the hydrocarbons around the injection well oxidize to carbon dioxide and the connate brine in the formation pores is converted to steam. If the reservoir temperature is below the ignition temperature, a special heater is used in the well to ignite the hydrocarbons in the target formation.

As the hydrocarbons adjacent to the injection well combust, hot gases and a pressure wave are produced in the target formation. The heat from contact with the hot gases reduces the viscosity of the heavy oil, vaporizes the light hydrocarbon fraction in the heavy oil and connate water, and causes some hydro cracking of the asphaltene fraction. The pressure wave saturates the oil with combustion gases and the surplus combustion gases gravity-override the oil in the formation as the combustion front moves towards the production wells drilled in the vicinity of the injection well.

As the combustion continues, the burning front pushes ahead a mixture of hot combustion gases, steam and condensed hot water as it gravity-overrides the oil in the target formation. This propagation, in turn, reduces the viscosity of oil further away from the injection well and displaces or gravity-drains more oil towards the production wells.

As the front progresses towards the production well, several zones can be formed between the injection wells and the production wells. These zones are a result of heat and mass transport and the chemical reactions occurring during the in-situ combustion process.

The combustion front is the highest temperature zone and is often no more than several inches thick. On the other hand, hundreds of feet may separate an injection well and a production well. At the combustion front, oxygen combines with the fuel (e.g., the coke or residuum) and oxidation occurs through a variety of oxidation reactions that produce steam and carbon oxides.

As the in-situ combustion (ISC) moves away from the injection well, fuel is deposited as hard coke or as a very thick residuum in the thermal cracking zone just ahead of the combustion front. This fuel is the product of cracking and pyrolysis that occurs in the presence of very hot steam and carbon dioxide. Some of the carbon dioxide is converted to carbon monoxide due to adsorption of oxygen on the residuum. Typically, the amount of fuel deposited in the pore volume is an important parameter because this amount determines how much oxygen-containing gas must be injected into the pattern to burn a desired fraction of the pattern pore volume and also determines the burn front velocity.

Downstream from the thermal cracking zone is the cracking/vaporization zone. In the cracking/vaporization zone, crude oil is modified by the high temperature of the combustion process that takes place in the combustion front. In the cracking/vaporization zone, light oils vaporize and get transported downstream where they condense and mix with displaced crude oil. Also, the heavier oil fraction pyrolyzes, resulting in the formation of methane, heavier hydrocarbon gases and solid organics that deposit thick residuum behind of the cracking/vaporization zone.

The chemical reactions associated with ISC process are typically complex and numerous. The associated low-temperature oxidations (LTO) are heterogeneous gas/liquid reactions producing partially oxygenated compounds and little carbon oxide gases. These reactions increase the heavy oil viscosity and can reduce the sweep efficiency of the combustion flood. Medium-temperature reactions form the fuel by cracking and pyrolysis of heavy hydrocarbon fraction. High-temperature oxidations (HTO) are heterogeneous H—C bond breaking reactions that form a solid fuel (coke) and the coke reacts with oxygen to form steam and carbon oxides.

Typically, ISC processes have poor vertical conformance in a layered formation due to the high mobility ratio between hot combustion gases and cold heavy oil. In other words, an ISC process often just burns through one high-permeability layer in the formation and keeps going once it reaches and passes the production well. The produced oxygen gas can flash with the oil produced from another layer and start a burn in the production well bore. In such instances, the intense heat then melts the casing and destroys the well. Thus, produced gases must be monitored for oxygen at all times to prevent ignition in the well bore.

Wet Combustion

Wet combustion is an in-situ combustion technique in which water is pumped either simultaneously or alternately with a gas containing oxygen (e.g., air) into an injection well. Wet combustion actually refers to wet forward combustion and was developed to recover the great amount of heat that would otherwise be lost to heat transfer to the surrounding layers bounding the target formation.

According to the wet combustion process, the injected gas containing oxygen develops a combustion front discussed above in connection with the ISC process. Then, the liquid water is co-injected with the oxygen-containing gas to recover the heat by flashing to steam behind the combustion front and transferring the heat to the oil bank ahead of the combustion front as a large steam plateau. Because of the additional energy and mass transfer to the oil bank ahead of the combustion front, the oil displacement during wet combustion is more efficient and requires less air injection than the dry ISC process.

In spite of these advantages, the wet combustion process encounters liquid-blocking problems. More specifically, at the burn front, some regions of the burn front drop into medium or low temperature combustion temperatures due to the high water-oxygen gas ratio drowning the combustion front. This usually happens when there is gravity segregation of the water and oxygen-containing gas in the formation. At the edge of the segregated water, there is no burning of fuel due to the lack of oxygen. Thus, it is simply hot water, instead of steam, attempting to displace heavy oil towards the production well. This in turn creates bypassed oil zones in the pattern.

SUMMARY OF THE INVENTION

The foregoing needs are met for teriary production of heavy oil formations, to a great extent, by certain embodiments of the present invention. According to one such embodiment, a method of oil production is provided. The method includes drilling an injection well and a production well in the target oil formation. The method also includes pumping a mixture of oxygen, carbon dioxide ($CO_2$) and a foaming agent into the injection well. In addition, the method also includes minimizing gravity segregation by providing a relatively high level of $CO_2$ in the gas mixture and soluble salt in the aqueous phase.

In addition to the above, according to certain embodiments of the present invention, a forward wet combustion method generates a miscible or near-miscible mixture of carbon dioxide gas and condensed light oil fraction to reduce residual oil saturation and heavy oil viscosity so the hydrocarbon liquid phase will be laterally displaced down dip to a production well at economic production rates. This method includes providing an alkali metal or ammonium salt brine that is co-injected with an oxygen containing gas. This is done (1) to generate a wet combustion front, (2) to catalytic up-grade the asphaltene fraction to a light oil fraction, (3) to create an in-situ surfactant by neutralizing petroleum acids, (4) to create a residuum-in-water emulsion displacing front along the bottom of the reservoir, and (5) to prevent corrosion of the metal casing. This method also includes providing a soluble boron and/or iron salt brine with the initial injection of carbon dioxide to (1) establish a mobile gas and brine displacing phase, (2) lower the ignition time and temperature and (3) minimize the fuel deposition during transition from low-temperature oxidation to high temperature oxidation. This method further includes providing at least one injection well completed relatively high on the structure of the reservoir for injecting an oxidizing gas and an aqueous solution to laterally form and extend a forward combustion front. According to certain embodiments of the present invention, composite plastic or fiberglass tubing and injection lines are used to prevent corrosion in the injection system. The method also includes providing at least one horizontal production well completed down-dip from the injection well with a direction that is essentially parallel to the strike of the reservoir and the advancing displacement front.

According to certain embodiments of the present invention, the injection well is prepared for ignition of the combustion front, especially if the well is a conversion of a production well. According to such embodiments, carbon dioxide and lower molecular weight alcohol such as isopropyl or methanol are co-injected to displace the oil from the near well bore region. The carbon-dioxide-rich liquid phase extracts the intermediate fraction from the heavy oil and precipitates the asphaultenes as solids. The asphaultenes will not gravity drain or back flash into the lower portion of the well bore upon ignition of the combustion front.

According to certain embodiments of the present invention, in the above-discussed process, the oxygen-containing gas has less than 5% nitrogen contamination, 0 to 80% carbon dioxide concentration, less than 6% hydrocarbon contamination, and 20 to 96% oxygen gas concentration. Also, between 5 and 30% hydrogen peroxide can be co-injected to aid in the ignition of the oil phase in the reservoir.

According to certain other embodiments, in the above-discussed process the alkali salt is composed of a sodium, potassium or an ammonium cation and a bicarbonate, carbonate, percarbonate, nitrate or a hydroxide anion. The source water is softened to prevent scale build up around the perforations or in the near wellbore area.

According to yet other embodiments, the continuous or cyclical addition of a surfactant is used to generate an in-situ foam from the alkali brine and oxygen-containing gas. The foam decreases the mobility of the displacing fluid in the higher permeability zones and diverts more oxygen containing gas into the lower permeability layers or zones. The overall effect is an increase in the vertical and areal sweep efficiency of the forward combustion front.

Also, according to certain embodiments of the present invention, the injection and production rates are adjusted to cycle the average reservoir pressure of the carbon dioxide rich gas displacement front by at least 200 psi and over at least a 3 month period. The cycling of the reservoir pressure allows the solution gas drive mechanism to displace oil from the low permeability zones or dead-end pore volume to re-saturate the high-permeability swept zones. The re-saturated oil is then swept to the production well during the next pressure cycle.

In addition, a back pressure of 50 to 400 psi may be held on the production well to prevent carbon dioxide rich gas from flashing out of solution and reducing oil mobility around the production wellbore. The flashing gas will create mobile gas saturation around the production wellbore and cause premature break through of the carbon dioxide gas front. This is particularly useful where a choke is used to hold back pressure on the casing annulus and/or were the pump is set high to create a hydrostatic head on the reservoir.

According to still other embodiments of the present invention, a mixture of carbon dioxide and light oil fraction is injected into the production well to reduce the heavy oil viscosity around the wellbore and to establish a gas phase mobility in the wellbore drainage area. This is particularly useful where the gas mixture is heated on the surface, injected into the well bore and condenses in the near wellbore area. This is also particularly useful where the horizontal wellbore is electrically heated and the gas mixture is injected into the well bore and condenses in the near well bore area to dilute the heavy oil viscosity. In addition, this is also particularly useful where the gas mixture and steam are co-injected to heat the formation and condense in the near wellbore area.

According to another embodiment of the present invention, a high-temperature surfactant is mixed with the injected alkali brine to increase the amount of residuum emulsified when the concentrated brine gravity drains down dip. Also, according to certain embodiments of the present invention, the rock matrix is a carbonate rock, carbon dioxide gas and acidic brine are injected before ignition to improve matrix permeability and the imbibition rate of hot brine into the tight reservoir matrix rock. Co-injection of a combustion catalyst and near pure oxygen gas is used to create a high temperature combustion front to maximize the conversion of carbonate matrix to alkali metal oxide and carbon dioxide gas. The carbonate rock conversions can double to triple the generated carbon dioxide volume. The generation of carbon dioxide gas from the carbonate rock and combustion would be used to create a near miscible flood of the heavy oil reservoir.

According to still another embodiment of the present invention, the injection wells are drilled near vertical in the reservoir and each row of injection wells are near parallel with the strike of the formation. Also, the production wells may be drilled horizontally, nearly parallel with the strike of the formation, and in the bottom 30% of the formation. For communication across a thick shale lens in the reservoir, the horizontal well can be drilled in a step path crossing the shale layer. The thin shale layers will thermally fracture from the heat generated in the combustion front.

In addition, according to another embodiment of the present invention, the combustion front overtakes a production well in this path. The production well is plugged back to the heel and re-perforated in the top of the formation to make an injection well. Additional near vertical injection wells are drilled and completed to make the next row of brine/oxygen gas injectors. The previous injection wells are converted to carbon-dioxide-rich gas injectors to maintain the gas cap pressure while the gas-containing oxygen is displaced towards the combustion front from the next row of injectors.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
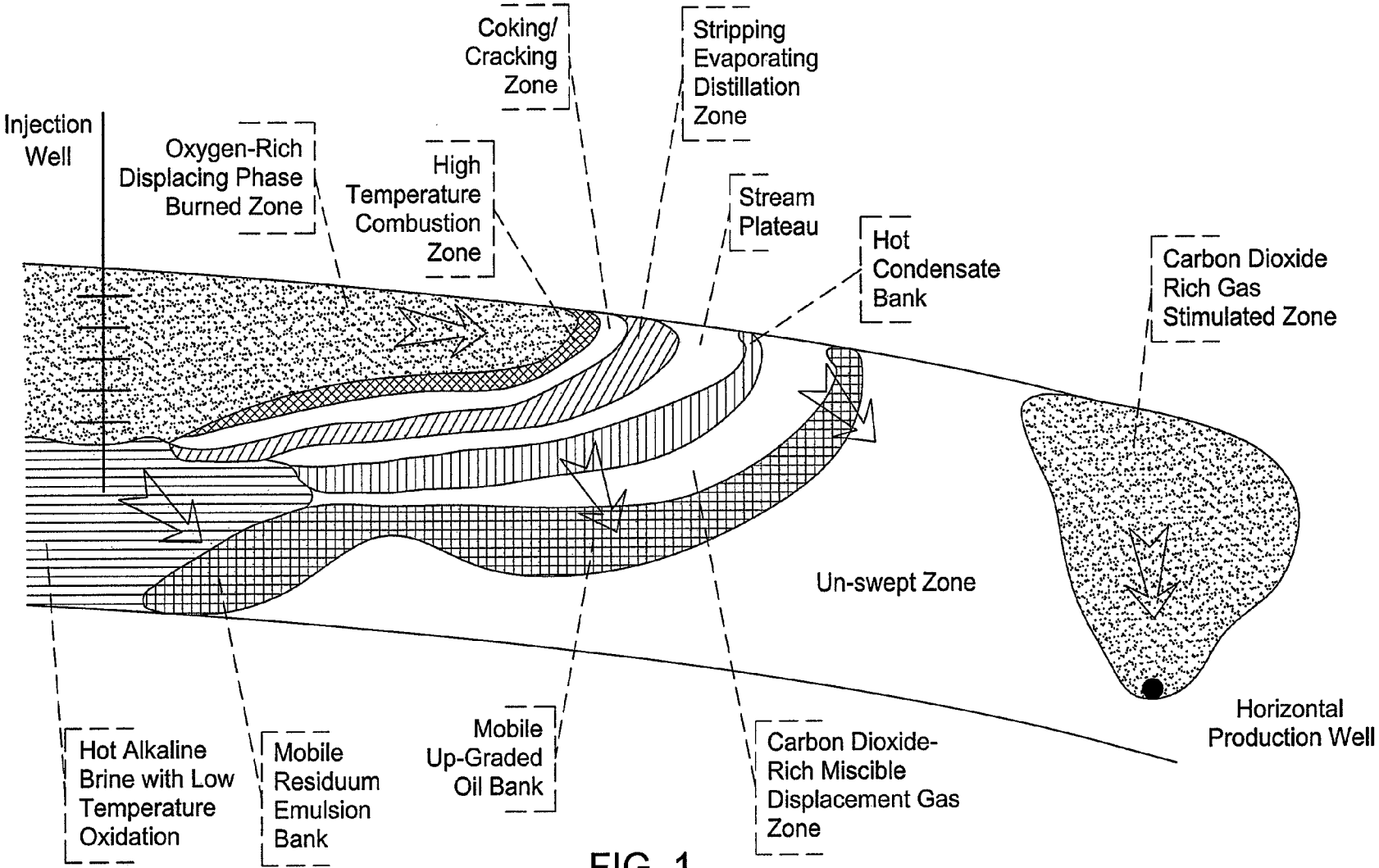
FIG. 1 illustrates a cross-sectional view of an oil production process according to an embodiment of the present invention.

The invention will now be described with reference to the drawing figures, in which like reference numerals refer to like parts throughout. Combined miscible displacement is an in-situ wet combustion technique in which an aqueous surfactant solution is pumped simultaneously with near-pure oxygen gas into the formation as foam. According to this technique, a high-temperature foaming agent is typically used to prevent the gravity segregation of water from the oxygen gas and to provide mobility control with heavy oil formations.

Wet foam forward combustion was developed to recover the great amount of heat that would otherwise be lost to heat transfer to the surrounding layers bounding the target formation. The foam promotes uniform burning along the combustion front in a formation with variable permeability in the horizontal and vertical directions. As the water evaporates from the foam, the quality of the foam increases until it reaches about 90%. Then, the foam breaks and becomes an oxygen-rich steam and an alkaline brine. The oxygen-rich steam and brine gravity-segregate to the top and bottom of the formation, respectfully. The foam displaces the oxygen-rich steam towards the gravity-overriding wet combustion front. Oxygen-rich combustion of the coke fuel produces intense heat and carbon-dioxide-rich flue gas. The carbon-dioxide-rich flue gas prevents low-temperature oxidation of the heavy oil and promotes near-miscible stripping of the light and medium oil fractions in the heavy oil.

As the alkaline brine drains through the residual hot oil/tar column, it reacts with the partially oxidized residuum to form a low-viscosity, water-external phase emulsion. This water-external phase emulsion is easily displaced by the injected foam towards the production well. By reducing the viscosity of the residual heavy oil, the vertical sweep efficiency of wet combustion is greatly improved. The foam agent and high temperature surfactant address the shortcomings of the normal wet combustion process.

Figure 2:
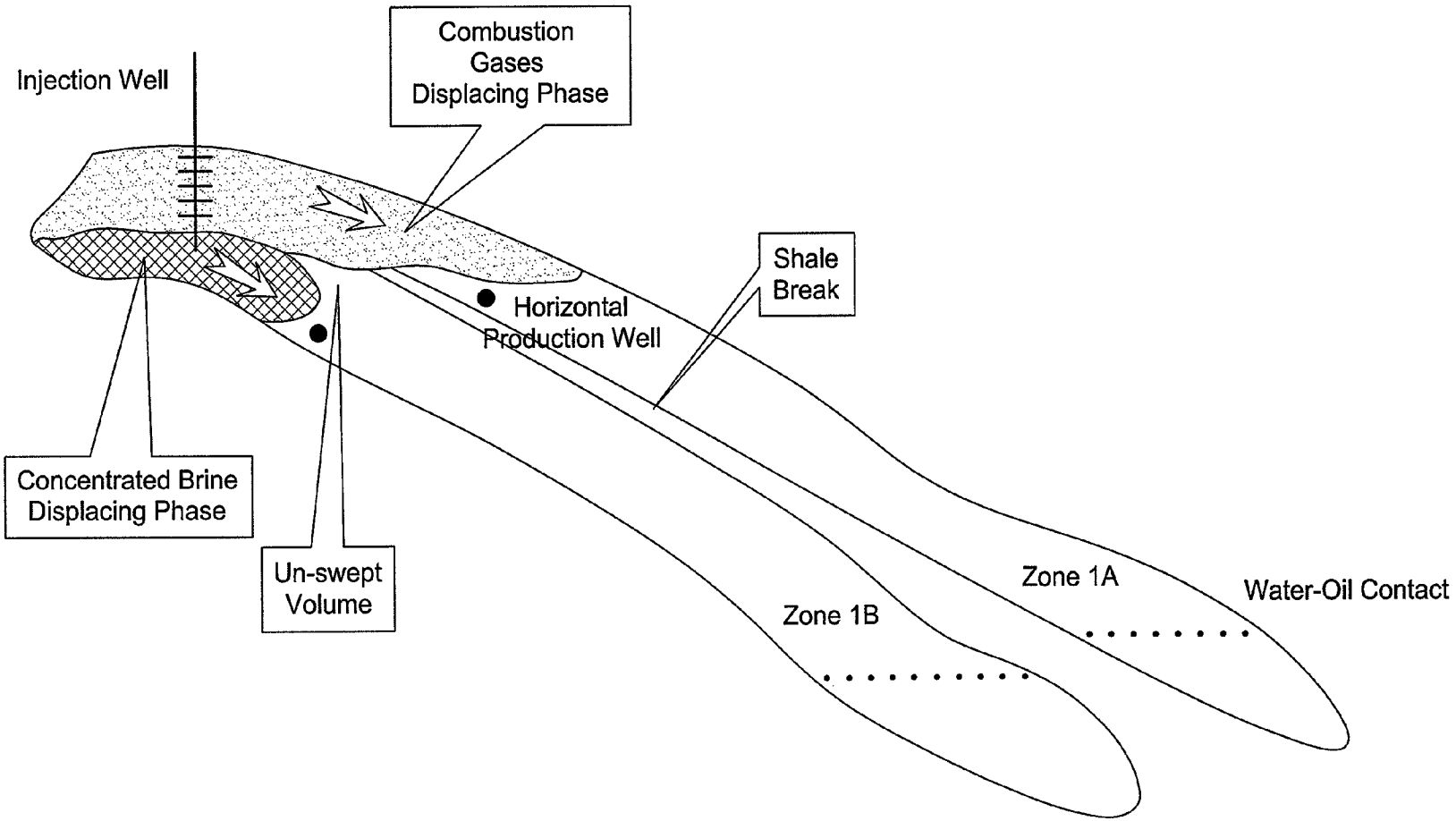
FIG. 2 illustrates another cross-sectional view of the oil production process illustrated in FIG. 1.

FIG. 1 illustrates a cross-sectional view of an oil production process according to an embodiment of the present invention. FIG. 2 illustrates another cross-sectional view of the oil production process illustrated in FIG. 1.

Oil production processes according to certain embodiments of the present invention include drilling one or more injection wells (multiple injection wells shown in FIG. 3) and one or more projection wells in contact with an underground oil reservoir. The production wells may be drilling horizontally, vertically or in any other desired orientation.

According to certain embodiments of the present invention, less than 5% nitrogen gas contamination is pumped into the injection well. In other words, air or enriched air is not used, as nitrogen gas increases the fuel lay down in the thermal cracking zone and increases the minimum miscibility pressure of the carbon dioxide rich flue gas. Rather, according to certain embodiments of the present invention, near-pure oxygen is pumped into the injection well, along with pure carbon dioxide ($CO_2$) or water or steam.

The oxygen pumped into the injection well, once it flows into the oil reservoir through one or more perforations in the well, causes oxidation and, as such, effectively starts an underground burning process in the reservoir. According to certain embodiments of the present invention, the gaseous mixture pumped into the injection well is initially relatively oxygen-rich. However, once a burn is initiated in the reservoir, the gaseous mixture pumped into the injection well can be adjusted to become very rich (e.g., up to approximately 80%) in carbon dioxide ($CO_2$). The high concentration of $CO_2$ used allows for the gaseous mixture to be miscible or near miscible with the oil at the pressures experienced at the depths where the oil is found. As the oil saturates with $CO_2$-rich gas, the oil swells and becomes much less viscous. Thus, less energy is required to move the oil towards a production well. The high concentration of $CO_2$ also allows for the gaseous mixture to be recycled in reservoir after it is produced.

The above notwithstanding, it should be noted that oil combustion with oxygen results in the production of intense heat, steam and $CO_2$. Hence, according to certain embodiments of the present invention, what is pumped into the injection well is a mixture of oxygen and water, which produces $CO_2$ and steam in the ground.

Figure 3:
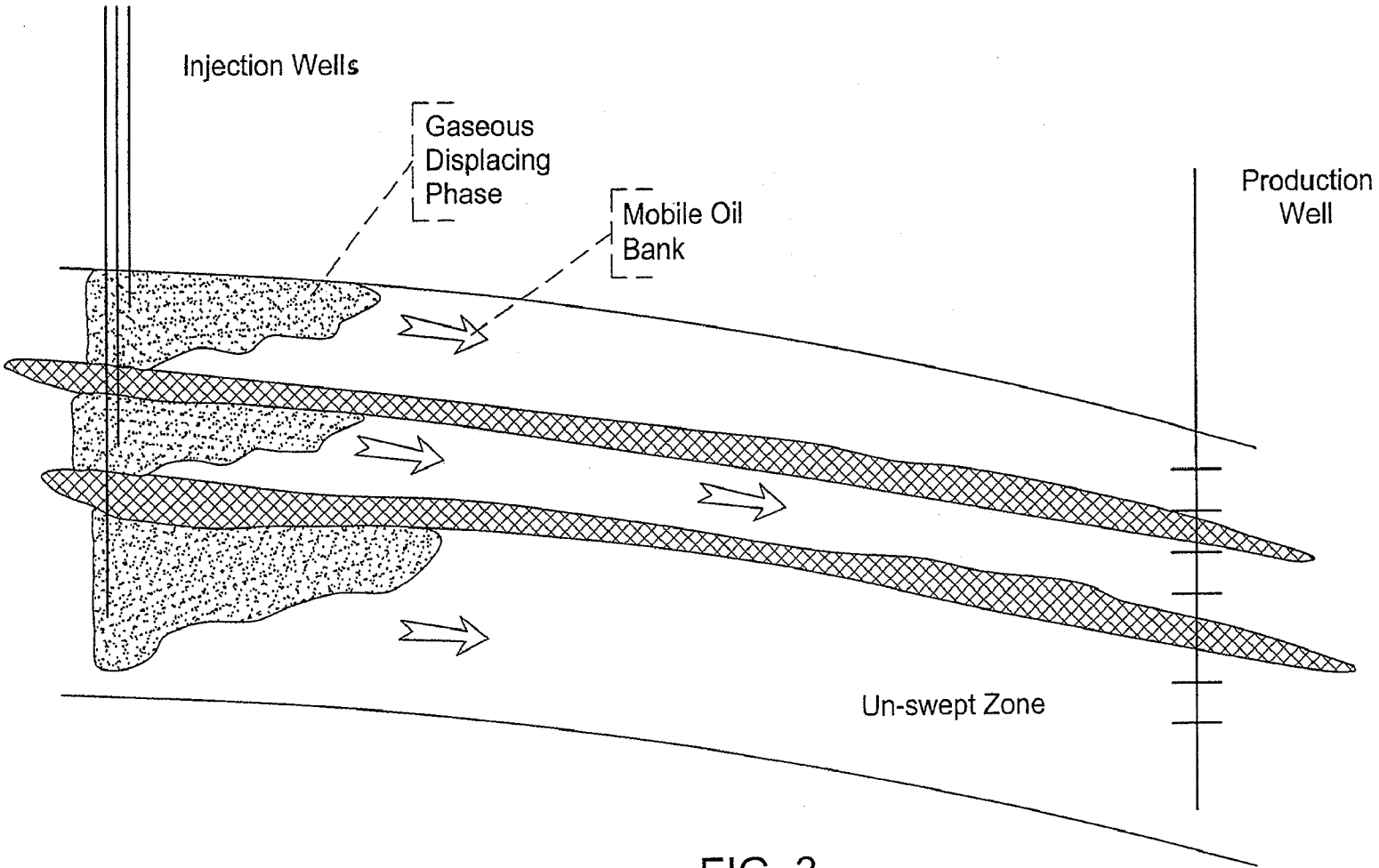
FIG. 3 illustrates a cross-sectional view of an oil production process according to an embodiment of the present invention wherein the injection well includes multiple injection wells.

As shown in FIG. 3, the goal of certain embodiments of the present invention is to provide a uniform burn front across a plurality of layers. In other words, certain embodiments of the present invention prevent gravity-segregation wherein a non-miscible gas phase propagates rapidly through the top of a reservoir layer and quickly breaks through the production well, thereafter wasting injected gas, energy and resources.

One of the advantages of using $CO_2$ in certain processes according to the present invention is that $CO_2$ is denser than water below 90 degrees Fahrenheit (i.e., $CO_2$ weighs approximately 10 pounds per gallon, which exceeds the density of brine, Which is approximately 9.0 pounds per gallon). Hence, instead of a light gas phase, certain embodiments of the present invention make use of a non-gravity-segregating near-critical phase of $CO_2$-rich gas mixture. These embodiments utilize a composition of nearly 100% $CO_2$. Also, for shallow heavy oil zones, $CO_2$ miscibility is enhanced with the appropriate mixture of low molecular weight alcohols (e.g., methanol or isopropanol) or various intermediate oil cuts.

According to certain embodiments of the present invention, catalyzed, high-temperature combustion is used to provide the intense heat for the hydro-cracking reactions in the oil reservoir. Thus, the heavy components found in the reservoir oil hydrocrack and release a plurality of intermediate-weight components. Once the steam front has passed, extra-heavy residuum will typically remain. Hence, when oxygen is injected along with an aqueous catalyst salt (e.g., potassium), a significant amount of light oil will be generated due to hydrocracking and a small amount of coke residue will remain.

In accordance with certain other embodiments of the present invention, heat transfer from the steam front lowers the viscosity of the residuum adjacent thereto. Also, the intermediates extracted with the $CO_2$ condense to make a less viscous oil phase that is displaced by the steam front.

In addition, according to certain embodiments of the present invention, the mixture that is pumped into the injection well includes approximately 80% oxygen and approximately 20% $CO_2$ by volume. According to certain embodiments, water with at least approximately 6000 ppm ofpotassium carbonate salt is also pumped into the injection well in order to prevent corrosion of the well casing. This gas mixture has a higher concentration of oxygen than is being used in currently available air injection processes. In order to prevent the creation of a lot of carbon monoxide contamination in the flue gases, the potassium carbonate also acts as a combustion catalyst. During the initial injection, a small amount of iron nitrate, iron citrate (i.e., soluble iron salts), or boron acid, may also be added as the combustion catalyst to accelerate the burn process.

It should be noted that, if only $CO_2$ were pumped into the injection well, a gaseous displacing phase, a mixing zone and a mobile oil bank would develop and there would be gravity segregation (i.e., the gas phase would move rapidly along the top of the un-swept zone). Heavy oil in an oil wet rock would still have a residual oil saturation over 20% of the original oil in place. It should also be noted that, if only a dense liquid phase (i.e., water including a surfactant) were pumped into the injection well to displace the heavy oil, the process would require the recycling of many pore volumes of injection fluid to mobilize the heavy oil, and would therefore not be cost-effective.

FIG. 1 illustrates a stage of an oil extraction process according to certain embodiments of the present invention wherein all of the components used to extract oil according to one embodiment of the present invention have been pumped into the injection well. As illustrated in FIG. 1, multiple banks are present between the injection well and the production well: an oxygen-rich phase, a high-temperature combustion zone, a coking/cracking zone, a stripping/evaporation/distillation zone, a steam plateau, a hot condensate bank, a $CO_2$-rich miscible displacement gas zone, a mobile upgraded oil bank, an un-swept zone, a $CO_2$-rich gas stimulated zone and a hot alkaline brine with low temperature oxidation zone.

In FIG. 1, the $CO_2$/rich miscible displacement gas zone prevents the gravity segregation that occurs in currently available oil-extraction processes. The $CO_2$/rich miscible displacement gas zone mixes with the oil to be extracted and forms a single phase that keeps the front from gravity segregating.

On the left side of FIG. 1, the mixture that is being pumped through the injection well includes oxygen, $CO_2$ and water. The water will include on the order of 10,000 ppm of potassium carbonate and on the order of 500 ppm of a foaming agent (i.e., a surfactant). The mixture enters the ground as a foam through the perforations in the injection well casing.

As the water in the foam mixture evaporates, the surfactant gets destroyed by the high temperatures and the water concentrates into the hot alkaline brine that gravity segregates to the bottom of the reservoir layer. Some low temperature oxidation occurs in the brine zone which creates petroleum acids that immediately react with alkaline salt to make petroleum soap. The hot alkaline brine typically includes a concentration of potassium of between 30,000 and 60,000 ppm and a pH of up to approximately 12. The carbonate ion in the potassium carbonate brine is transformed into carbon dioxide gas with high temperature and becomes part of a gas phase that includes steam, oxygen and $CO_2$.

In addition to the above, as the burn front moves away from the injection well, the oil adjacent to the steam front effectively gets distilled. As such, a portion of the heated oil is converted into a residuum and drains along with the hot alkaline brine to form a water external phase emulsion. The alkali ion reacts with the petroleum acid to make a low-viscosity emulsion, typically with a viscosity of approximately 100 centipoise or less. This emulsion is identified in FIG. 1 as the mobile residuum emulsion bank. and flows down dip towards the production well. Typically, there will be a continuous viscosity gradient between the mobile upgraded oil bank and the mobile residuum emulsion bank. According to certain embodiments of the present invention, the upgraded oil at the top of the reservoir illustrated in FIG. 1 may have a specific gravity of 25, whereas the mobile residuum at the bottom of the reservoir may have a specific gravity of 11 or lower.

The high temperature combustion zone is where coke burns in the presence of oxygen, with a bit of the above-mentioned potassium catalyst, although some of the potassium injected into the reservoir does evaporate into the steam, as would cesium if any were added to the injection mix. The approximate temperature in the high temperature combustion zone is typically on the order of 2000 degrees Fahrenheit.

Immediately in front of the high-temperature combustion zone is the coking/cracking zone. In the coking/cracking zone, heavy residuum (e.g., oil with a viscosity analogous to roofing tar) is being cracked into an intermediate fraction and some carbon dioxide is being reduced to carbon monoxide. Not only does potassium, along with any iron that may also be injected according to certain embodiments of the present invention, assist with the burning process in the high temperature combustion zone, but, the potassium ion also is transported in a vapor phase to the coking/cracking zone and assists/catalyzes the hydrocracking process.

In front of the coking/cracking zone (i.e., pursuant to the coking and cracking processes and in the stripping/evaporation/distillation zone), the remaining cracked components are typically benzene-ring-type compounds. At that point, one or more benzene rings are stripped off of the compounds and one or more hydrogen atoms are stripped off of the remaining benzene rings, thus leaving compounds that are analogous in structure to anthracite coal (i.e., one or two hydrogen atoms remain on the benzene ring and there are numerous carbon-carbon bonds). It should also be noted that light oils (i.e., oils of low molecular weight) evaporate in the stripping/evaporation/distillation zone.

Typically, in the stripping/evaporation/distillation zone, a substantial amount of $CO_2$ enters (e.g., 80 volume percent) along with compounds from the coking/cracking zone, including 3-4% each of nitrogen and carbon monoxide. Some of the $CO_2$ reacts with free radicals present and donates some oxygen atoms to produce carbon monoxide, carbonic acid and benzene ring compounds. Due to the temperature gradient involved, distillation and stripping occurs in the right-most portion of the stripping/evaporation/distillation zone illustrated in FIG. 1 and evaporation occurs adjacent to the coking/cracking zone. Typically, the coking/cracking zone has a temperature of between 500 and 700 degrees Fahrenheit and at the boundary of the steam plateau (i.e., on the other side of the evaporation) the temperature is approximately 337 degrees (assuming that the pressure is approximately 2000 psi). In other words, the evaporation boundary is where the temperature falls below the steam condensation temperature.

In the steam plateau, the temperature is constant across the zone, condensation takes place, and the water vapor content typically goes from approximately 18 percent on the left side of the steam plateau to approximately 88 percent on the right side of the steam plateau. It is in this region that the earlier-discussed carbon monoxide is converted into $CO_2$ and that carbonated water is produced To the right of the steam plateau is the hot condensate bank. It is in this region that the earlier-discussed intermediate oil fraction is condensing into the liquid phase and mixing with the carbon dioxide saturated oil.

Because of the high level of $CO_2$ present, most components other than water do tend to condense in the $CO_2$-rich miscible displacement gas zone. It is in this zone that the gas is fairly dry (i.e., most of the water vapor has been condensed out earlier) and that light oil fraction are condensed. The $CO_2$ will attempt to saturate the oil zones.

It will be appreciated by one skilled in the art that the above condensation of intermediate and light oil fractions overcomes the gravity segregation problems found in currently available oil production methods. More specifically, one skilled in the art will appreciate the gas phase in in-situ combustion methods according to certain embodiments of the present invention condenses before reaching the production well instead of remaining gaseous. Once condensed, the components in the gases according to embodiments of the present invention are of a similar density to the oil in the reservoir and therefore do not gravity segregate while mixing with the heavy oil.

As an added advantage, because of the miscibility of the $CO_2$ approximately ⅔ of the energy that would be lost if steam were pumped into the injection well is instead transferred into the reservoir oil, thereby reducing the viscosity thereof. In addition, another advantage is that carbon dioxide acts like a non-condensable gas in the steam plateau, thus extending the temperature range by lowering the partial pressure to steam ratio.

At the production well, a $CO_2$-rich gas stimulated zone is generated by pumping $CO_2$ mixed with alcohol (e.g., isopropanol, ethanol or methanol) into the production well. Once injected, the $CO_2$ migrates upwards toward the surface and create a gas-phase region that has a lower oil viscosity and gas saturation. By generating such a region, some of the $CO_2$ will be absorbed by cold oil moving towards the production well, thereby reducing the viscosity of the oil and allowing the oil to gravity drain towards the production well and increasing the gravity drainage rate.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents maybe resorted to, falling within the scope of the invention.

What is claimed is:

1. A method of oil production, the method comprising:

forming an injection well and a production well;

pumping an aqueous surfactant solution into the injection well the aqueous surfactant solution comprising:

a potassium carbonate brine; and a surfactant;

pumping a gas into the injection well to generate a burning process having a combustion front, the gas comprising:

oxygen at a concentration range of 20% to 96% by volume;

carbon dioxide (CO2) at a concentration of 0% to 80% by volume; and nitrogen at a concentration of less than 5% by volume; and generating a foam with the aqueous surfactant solution and the gas, wherein the foam reduces gravity segregation and wherein the foam provides oxygen-rich steam along the combustion front in an oil formation.

2. The method of claim 1, further comprising:

injecting at least one of an alkali metal brine and an ammonium salt brine along with the aqueous surfactant solution.

3. The method of claim 2, wherein the injecting step comprises using an alkali salt that includes at least one of a sodium, potassium and ammonium cation and at least one of a bicarbonate, carbonate, percarbonate, nitrate and hydroxide anion to form the alkali metal brine.

4. The method of claim 3, further comprising:

mixing a high-temperature surfactant with the alkali brine.

5. The method of claim 1, further comprising:

injecting at least one of a soluble boron salt brine and an iron salt brine mixture before pumping the aqueous surfactant into the injection well.

6. The method of claim 1, further comprising:

placing the injection well at an upper portion of an oil reservoir.

7. The method of claim 1, further comprising:

using at least one of composite plastic tubing and fiberglass tubing as injection tubing in the injection well to prevent corrosion.

8. The method of claim 1, further comprising:

selecting the gas to contain less than 5 vol. % nitrogen, between 0 and 80 vol. % carbon dioxide, less than 6 vol. % hydrocarbons, and between 20 and 96 vol. % oxygen gas.

9. The method of claim 1, further comprising:

injecting between 5 and 30 vol. % hydrogen peroxide and saturated ammonium nitrate solution as part of the aqueous surfactant solution.

10. The method of claim 1, further comprising:

adding a surfactant in at least one of a continuous manner and a cyclical manner to generate a foam from the aqueous surfactant solution.

11. The method of claim 1, further comprising:

adjusting at least one of an injection rate of the aqueous surfactant solution and gas into the injection well and a production rate from the production well to cycle an average reservoir pressure of a carbon dioxide-rich gas displacement front by at least 200 psi and over at least a three-month period.

12. The method of claim 1, further comprising:

holding a back pressure of 50 to 400 psi on the production well.

13. The method of claim 1, further comprising:

Injecting at least one of a mixture of carbon dioxide and light oil fraction and a mixture of carbon dioxide and alcohol into the production well.

14. The method of claim 1, further comprising:

fracturing a shale layer with heat generated at the combustion front.

15. The method of claim 1, further comprising:

drilling additional injection wells near vertical and near parallel with a strike of a formation containing oil.

16. The method of claim 1, further comprising:

drilling a horizontal production well in at least on of a sinusoidal path and a stepped path crossing shale layers to connect productive zones.

17. The method of claim 1, further comprising:

cementing coiled tubing into production well and perforating injection points along the production well to make a next injection well pattern along a strike.

18. The method of claim 1, further comprising:

reducing a viscosity of oil in the oil formation by including $CO_2$ at 80% by volume in the gas.

* * * * *